US011037710B2

(12) United States Patent
Ravindranathan et al.

(10) Patent No.: US 11,037,710 B2
(45) Date of Patent: Jun. 15, 2021

(54) VARISTOR PASSIVATION LAYER AND METHOD OF MAKING THE SAME

(71) Applicant: AVX Corporation, Fountain Inn, SC (US)

(72) Inventors: Palaniappan Ravindranathan, Simpsonville, SC (US); Marianne Berolini, Greenville, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 16/514,136

(22) Filed: Jul. 17, 2019

(65) Prior Publication Data

US 2020/0027631 A1 Jan. 23, 2020

Related U.S. Application Data

(60) Provisional application No. 62/699,893, filed on Jul. 18, 2018.

(51) Int. Cl.
*H01C 7/12* (2006.01)
*H01C 7/04* (2006.01)
(Continued)

(52) U.S. Cl.
CPC ..... *H01C 7/126* (2013.01); *H01C 1/144* (2013.01); *H01C 7/044* (2013.01); *H01C 7/18* (2013.01)

(58) Field of Classification Search
CPC ..... H01C 7/126; H01C 1/144; H01C 7/044
(Continued)

(56) References Cited

U.S. PATENT DOCUMENTS 5,307,046 A * 4/1994 Alim ..... C04B 14/106 106/286.2
5,614,074 A 3/1997 Ravindranathan
(Continued)

FOREIGN PATENT DOCUMENTS

CN 1226756 C 11/2005
DE 102004005664 9/2005
(Continued)

OTHER PUBLICATIONS

International Search Report and Written Opinion for PCT/US2019/042178 dated Nov. 8, 2019, 10 pages.
(Continued)

*Primary Examiner* — Edwin A. Leon
*Assistant Examiner* — Iman Malakooti
(74) *Attorney, Agent, or Firm* — Dority & Manning, P.A.

(57) ABSTRACT

In general, a varistor including a passivation layer and a method of forming such a varistor are disclosed. The varistor comprises a ceramic body comprising a plurality of alternating dielectric layers and electrode layers. The varistor also comprises a first external terminal on a first end surface and a second external terminal on a second end surface opposite the first end surface wherein at least two side surfaces extend between the first end surface and the second end surface. The varistor also comprises a passivation layer on at least one side surface of the ceramic body between the first external terminal and the second external terminal. The passivation layer includes a phosphate and a metal additive including an alkali metal, an alkaline earth metal, or a mixture thereof. The passivation layer has an average thickness of from 0.1 microns to 30 microns.

29 Claims, 6 Drawing Sheets

(51) Int. Cl.
*H01C 7/18* (2006.01)
*H01C 1/144* (2006.01)

(58) Field of Classification Search
USPC ..... 338/21
See application file for complete search history.

(56) References Cited

U.S. PATENT DOCUMENTS

| | | | |
|---|---|---|---|
| 5,750,264 | A | 5/1998 | Ueno et al. |
| 5,757,263 | A | 5/1998 | Ravindranathan |
| 5,837,178 | A | 11/1998 | Cowman et al. |
| 5,866,196 | A | 2/1999 | Ueno et al. |
| 6,090,435 | A | 7/2000 | Ueno et al. |
| 6,127,040 | A | 10/2000 | Grobbauer et al. |
| 6,171,644 | B1 | 1/2001 | Jinno et al. |
| 6,183,685 | B1 | 2/2001 | Cowman et al. |
| 6,214,685 | B1 | 4/2001 | Clinton et al. |
| 6,232,144 | B1 | 5/2001 | McLoughlin |
| 6,232,867 | B1 | 5/2001 | Yoshida et al. |
| 6,400,253 | B1 | 6/2002 | Jino et al. |
| 6,545,857 | B2 | 4/2003 | Kishimoto et al. |
| 6,608,547 | B1 | 8/2003 | Greier et al. |
| 6,841,191 | B2 | 1/2005 | Wu |
| 6,930,438 | B2 | 8/2005 | Cramer et al. |
| 7,075,405 | B2 | 7/2006 | Takehana et al. |
| 7,123,467 | B2 | 10/2006 | Greier et al. |
| 7,341,639 | B2 | 3/2008 | Greier et al. |
| 7,688,177 | B2 | 3/2010 | Saito et al. |
| 7,751,176 | B2 | 7/2010 | Iguchi et al. |
| 7,813,104 | B2 | 10/2010 | Nakano et al. |
| 7,928,558 | B2 | 4/2011 | Brunner et al. |
| 8,044,760 | B2 | 10/2011 | Feichtinger et al. |
| 8,077,008 | B2 | 12/2011 | McLoughlin |
| 8,130,071 | B2 | 3/2012 | Jost et al. |
| 8,134,447 | B2 | 3/2012 | Pecina et al. |
| 8,179,210 | B2 | 5/2012 | Feichtinger |
| 8,194,388 | B2 | 6/2012 | Koppel et al. |
| 8,203,824 | B2 | 6/2012 | Pecina et al. |
| 8,415,251 | B2 | 4/2013 | Brunner et al. |
| 8,730,645 | B2 | 5/2014 | Feichtinger et al. |
| 8,730,648 | B2 | 5/2014 | Wozniak et al. |
| 9,064,623 | B2 | 6/2015 | Shirakawa et al. |
| 9,202,627 | B2 | 12/2015 | Shirakawa et al. |
| 9,230,719 | B2 | 1/2016 | Feichtinger et al. |
| 9,263,191 | B2 | 2/2016 | Shirakawa et al. |
| 9,496,088 | B2 | 11/2016 | Shirakawa et al. |
| 9,595,391 | B2 | 3/2017 | Inoue et al. |
| 9,659,713 | B2 | 5/2017 | Shirakawa et al. |
| 9,734,948 | B2 | 8/2017 | Dernovsek et al. |
| 9,805,846 | B2 | 10/2017 | Feichtinger et al. |
| 9,865,397 | B2 | 1/2018 | Tanaka et al. |
| 9,870,866 | B2 | 1/2018 | Noda et al. |
| 9,875,831 | B2 | 1/2018 | Dernovsek et al. |
| 9,934,892 | B2 | 4/2018 | Sun et al. |
| 9,959,975 | B2 | 5/2018 | Inoue et al. |
| 9,966,191 | B2 | 5/2018 | Noda et al. |
| 9,972,440 | B2 | 5/2018 | Okai et al. |
| 9,978,521 | B2 | 5/2018 | Okai et al. |
| 9,991,054 | B2 | 6/2018 | Okai et al. |
| 9,997,293 | B2 | 6/2018 | Inoue et al. |
| 9,997,297 | B2 | 6/2018 | Okai et al. |
| 2002/0050911 | A1 | 5/2002 | McLoughlin |
| 2003/0150741 | A1* | 8/2003 | Wu ..... H01C 17/02 205/205 |
| 2007/0128822 | A1 | 6/2007 | McLoughlin et al. |
| 2007/0235834 | A1 | 10/2007 | Brunner et al. |
| 2007/0271782 | A1 | 11/2007 | Block et al. |
| 2007/0273469 | A1* | 11/2007 | Lien ..... H01C 7/112 338/21 |
| 2010/0189882 | A1 | 7/2010 | Hopper et al. |
| 2010/0206624 | A1 | 8/2010 | Feichtinger |
| 2011/0157768 | A1* | 6/2011 | Hur ..... H01G 4/008 361/321.2 |
| 2013/0020913 | A1 | 1/2013 | Shirakawa et al. |
| 2013/0208401 | A1 | 8/2013 | Shirakawa et al. |
| 2016/0024346 | A1* | 1/2016 | Inoue ..... H01G 4/224 361/301.4 |
| 2016/0276089 | A1 | 9/2016 | Inoue et al. |
| 2017/0221612 | A1 | 8/2017 | Yang et al. |
| 2017/0221613 | A1 | 8/2017 | Yang et al. |
| 2017/0290164 | A1 | 10/2017 | Feichtinger |
| 2017/0372820 | A1 | 12/2017 | Wozniak |
| 2018/0166218 | A1 | 6/2018 | Noda et al. |
| 2018/0166219 | A1 | 6/2018 | Noda et al. |

FOREIGN PATENT DOCUMENTS

| | | | |
|---|---|---|---|
| EP | 0806780 | 8/2000 | |
| JP | S5534568 | 9/1980 | |
| KR | 1020060082540 | * 7/2006 | ..... C03C 10/08 |
| KR | 1020160130653 | 11/2016 | |
| TW | I270089 | 1/2007 | |

OTHER PUBLICATIONS

Lee et al., "Fabrication and characterization of zinc phosphate passivation layers for ZnO-based varistor", ScienceDirect, Journal of European Ceramic Society 26 (2006) 3279-3285.

* cited by examiner

Control

Comparative Sample 1

Sample 2

Sample 3

VARISTOR PASSIVATION LAYER AND METHOD OF MAKING THE SAME

CROSS-REFERENCE TO RELATED APPLICATION

The present application claims filing benefit of U.S. Provisional Patent Application No. 62/699,893 having a filing date of Jul. 18, 2018 and which is incorporated herein by reference in its entirety.

BACKGROUND OF THE INVENTION

Varistors are voltage-dependent nonlinear resistors and have been used as surge absorbing electrodes, arresters, and voltage stabilizers. Varistors are typically constructed with a plurality of stacked dielectric-electrode layers. During manufacture, the layers may often be pressed and formed into a vertically stacked structure. Thereafter, external terminals and plating layers may be formed on the end faces and the extremities of the side faces for electrical contact and surface mounting. Typically, the plating layers are formed using plating solutions. However, such plating solutions have a tendency to react with the exposed ceramic of the varistors. While passivation techniques have been employed to protect the ceramic from plating, these techniques have typically resulted in a reduction in quality of the electrical path between the inner electrodes and the termination plating.

As a result, there is a need to provide an improved method for passivating any exposed ceramic of a varistor prior to plating the external terminals and for providing a varistor made according to such process.

SUMMARY OF THE INVENTION

In accordance with one embodiment of the present invention, a varistor is disclosed. The varistor comprises a ceramic body comprising a plurality of alternating dielectric layers and electrode layers. The varistor also comprises a first external terminal on a first end surface and a second external terminal on a second end surface opposite the first end surface wherein at least two side surfaces extend between the first end surface and the second end surface. The varistor also comprises a passivation layer on at least one side surface of the ceramic body between the first external terminal and the second external terminal. The passivation layer includes a phosphate and a metal additive including an alkali metal, an alkaline earth metal, or a mixture thereof. The passivation layer has an average thickness of from 0.1 microns to 30 microns.

In accordance with another embodiment of the present invention, a method of forming a varistor is disclosed. The method comprises applying a solution containing a phosphoric acid and a metal additive including an alkali metal, an alkaline earth metal, or a mixture thereof to a component including the following: a ceramic body comprising a plurality of alternating dielectric layers and electrode layers, a first external terminal on a first end surface, a second external terminal on a second end surface opposite the first end surface, and at least two side surfaces extending between the first end surface and the second end surface. The varistor also comprises a passivation layer on at least one side surface of the ceramic body between the first external terminal and the second external terminal. The passivation layer has an average thickness of from 0.1 microns to 30 microns.

BRIEF DESCRIPTION OF THE DRAWINGS

A full and enabling disclosure of the present subject matter, including the best mode thereof, directed to one of ordinary skill in the art, is set forth in the specification, which makes reference to the appended figure, in which.

Figure 1:
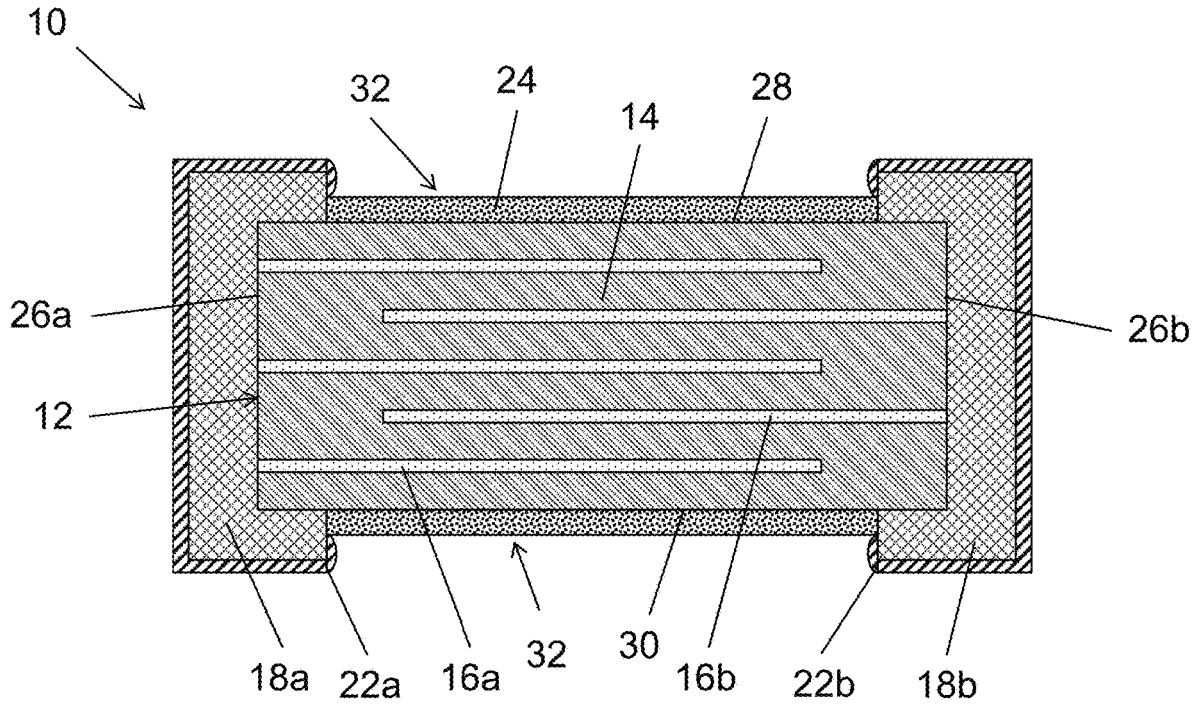
FIG. 1 illustrates a varistor including a passivation layer in accordance with aspects of this disclosure.

Repeat use of reference characters throughout the present specification and appended drawings is intended to represent same or analogous features, electrodes, or steps of the present subject matter.

DETAILED DESCRIPTION OF THE INVENTION

It is to be understood by one skilled in the art that the present disclosure is a description of exemplary embodiments only, and is not intended as limiting the broader aspects of the present subject matter, which broader aspects are embodied in the exemplary constructions.

Generally, the present disclosure is directed to a varistor having a passivation layer and a method of making such a layer. In general, the passivation layer is an electrically insulative layer, in particular an inorganic electrically insulative layer, that can be employed to protect or passivate any exposed ceramic prior to plating of the external terminals. According to the present invention, such passivation layer is formed from a modified phosphoric acid solution. The present inventors have discovered that the modified phosphoric acid solution as further described herein can enhance the properties of the passivation layer and corresponding varistor.

Figure 3:
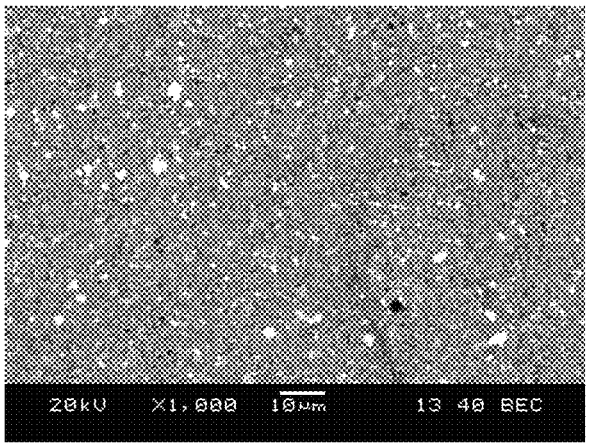
FIG. 3 illustrates the surface morphology of an exposed ceramic body and various passivation layers in accordance with an example of the present disclosure.
Figure 3:
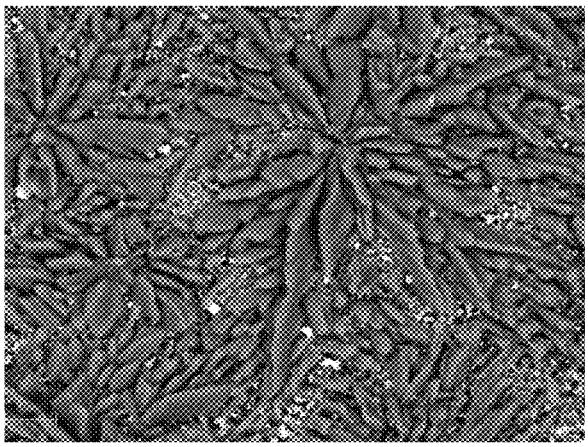
Figure 3:
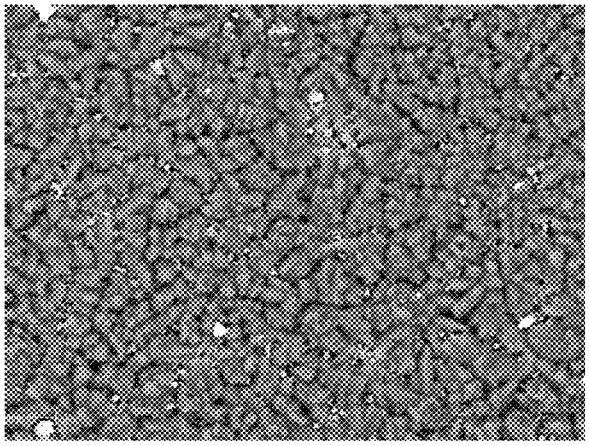
Figure 3:
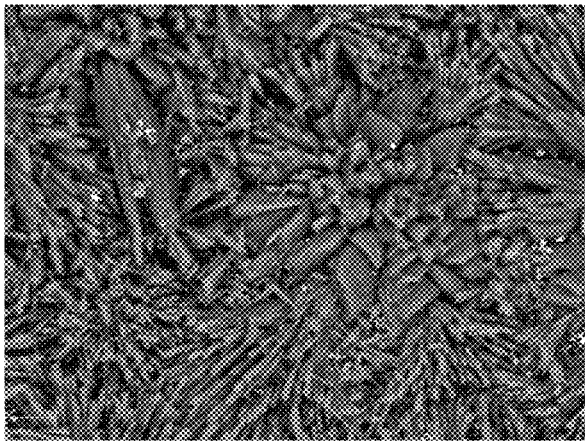
Figure 4:
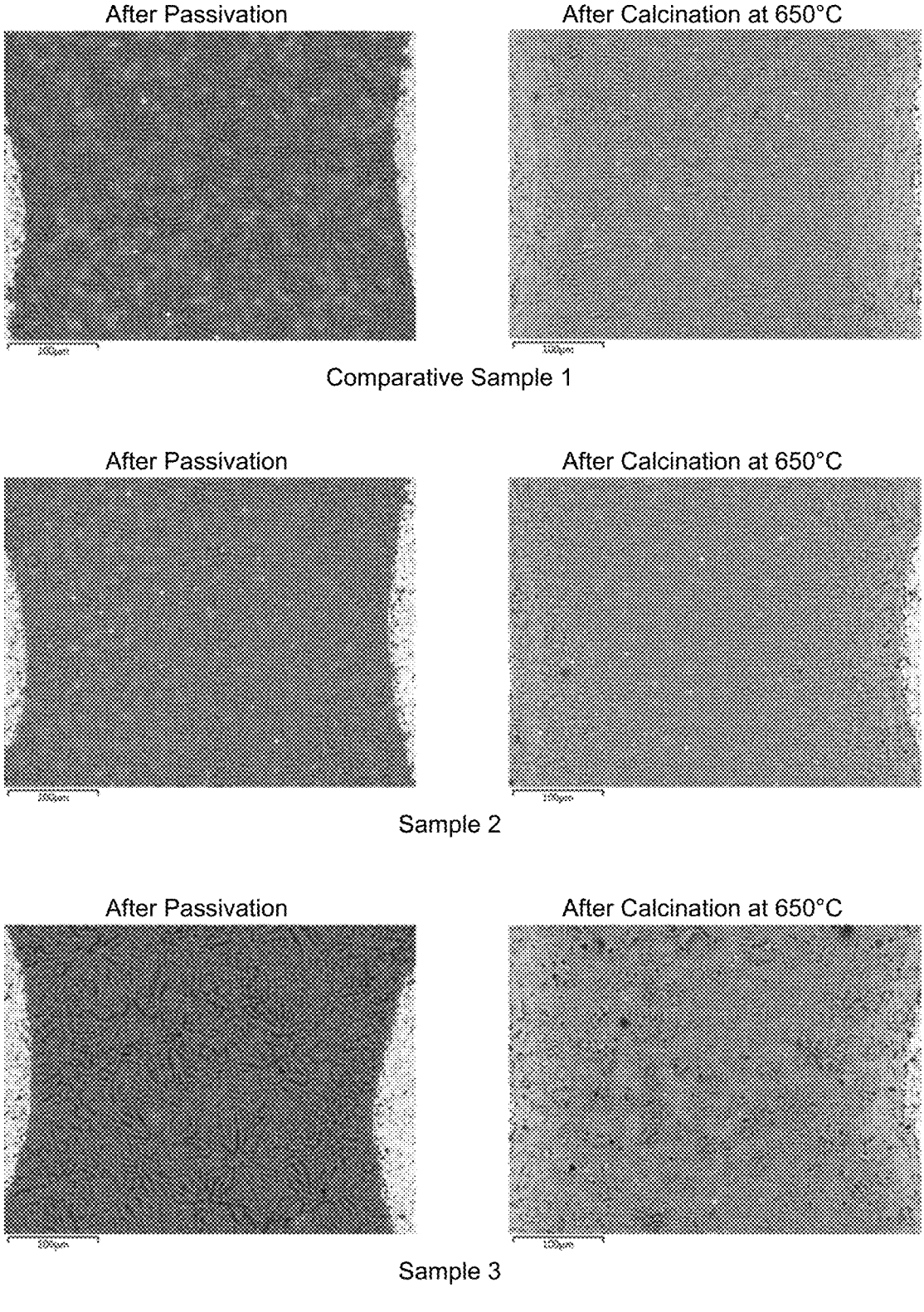
FIG. 4 illustrates the surface morphology of various passivation layers after calcination in accordance with an example of the present disclosure.

For instance, the metal additives may allow for better control of the morphology and thickness of the passivation layer. In particular, by employing the metal additives as disclosed herein, the structure and morphology of the passivation layer changes as the varistor and passivation layer are calcined. In particular, the crystal structure generally collapses to a glassy surface that covers the surface of the exposed ceramic. Such changes are further discussed below with respect to the examples and FIGS. 3 and 4. As illustrated in FIG. 4 in comparison to FIG. 3, less than 50% of the surface area, such as less than 40% of the surface area, such as less than 30% of the surface area, such as less than 20% of the surface area, such as less than 10% of the surface area, such as less than 5% of the surface area may include platelets as generally understood in the art after calcination, in particular at 650° C. Such surface area may be the entire surface area of the passivation layer or may be at least 50 $\mu m^2$, such as at least 100 $\mu m^2$, such as at least 250 $\mu m^2$, such as at least 500 $\mu m^2$, such as at least 1,000 $\mu m^2$, such as at least 5,000 $\mu m^2$, such as at least 10,000 $\mu m^2$, such as at least 25,000 $\mu m^2$, such as at least 50,000 $\mu m^2$, such as at least 100,000 $\mu m^2$, such as at least 150,000 $\mu m^2$ of the passivation layer.

In turn, the present inventors have discovered that the passivation layer is more stable and electrically non-conducting. In addition, with such control, the present inventors are able to obtain a passivation layer having an average thickness of from 0.1 microns to 30 microns. In general, the average thickness of the passivation layer may be 30 microns or less, such as 20 microns or less, such as 15 microns or less, such as 10 microns or less, such as 8 microns or less, such as 5 microns or less. The thickness of the passivation layer may be 0.1 microns or more, such as 0.5 microns or more, such as 1 micron or more, such as 2 microns or more, such as 3 microns or more, such as 5 microns or more.

In addition to controlling the properties of the passivation layer, the varistor including the passivation layer as disclosed herein may exhibit improved electrical performance. Typically, when calcining varistors and corresponding passivation layers at high temperatures, the resulting varistor may exhibit a generally low breakdown voltage. However, the present inventors have discovered that by using the modified phosphoric acid solution containing the metal additives as disclosed herein, the varistor may have a breakdown voltage of 4 volts or more, such as 5 volts or more, such as 10 volts or more, such as 15 volts or more, such as 20 volts or more, such as 25 volts or more, such as 30 volts or more, such as 40 volts or more, such as 45 volts or more, such as 50 volts or more. The breakdown voltage may be 300 volts or less, such as 250 volts or less, such as 200 volts or less, such as 175 volts or less, such as 150 volts or less, such as 125 volts or less, such as 100 volts or less, such as 90 volts or less, such as 80 volts or less, such as 70 volts or less, such as 60 volts or less, such as 55 volts or less.

While the initial breakdown voltage may be relatively high, the present inventors have discovered that there may be minimal change in such breakdown voltage even after conducting various tests. In particular, such breakdown voltage may be realized even after a life test conducted at an operating voltage of 32 volts and a temperature of 125° C. for 100 hours. For instance, the breakdown voltage may be at least 70%, such as at least 80%, such as at least 85%, such as at least 90%, such as at least 95%, such as at least 97%, such as at least 98%, such as at least 99% of the initial breakdown voltage. In addition, such breakdown voltage may be realized even after conducting the test for 200 hours and in one embodiment, even after conducting the test for 500 hours. Such breakdown voltage may be realized even after conducting the test for 1000 hours.

Furthermore, such breakdown voltage may also be realized after conducting a temperature humidity bias test at a temperature of 85° C., humidity of 85%, and an operating voltage of 32 volts for 100 hours. For instance, the breakdown voltage may be at least 70%, such as at least 80%, such as at least 85%, such as at least 90%, such as at least 95%, such as at least 97%, such as at least 98%, such as at least 99% of the initial breakdown voltage. In addition, such breakdown voltage may be realized even after conducting the test for 200 hours and in one embodiment, even after conducting the test for 500 hours. Such breakdown voltage may be realized even after conducting the test for 1000 hours.

Aside from the breakdown voltage, the varistor as disclosed herein may also exhibit other improved electrical properties that may be suitable for particular applications. For instance, the varistor may also exhibit a low leakage current. For example, the leakage current at an operating voltage of 32 volts may be about 1000 μA or less, such as about 500 μA or less, such as about 100 μA or less, such as about 50 μA or less, such as about 25 μA or less, such as about 20 μA or less, such as about 15 μA or less, such as about 10 μA or less, such as about 5 μA or less, such as about 3 μA or less, such as about 2 μA or less, such as about 1 μA or less, such as about 0.5 μA or less, such as about 0.1 μA or less. The leakage current at an operating voltage of 32 volts may be more than 0 μA, such as about 0.0001 μA or more, such as about 0.001 μA or more, such as about 0.01 μA or more, such as about 0.05 μA or more, such as about 0.1 μA or more, such as about 0.15 μA or more, such as about 0.2 μA or more, such as about 0.25 μA or more, such as about 0.3 μA or more.

In addition, the leakage current may also be within the aforementioned ranges even after a life test conducted at an operating voltage of 32 volts and a temperature of 125° C. for 100 hours. In particular, such leakage current may be realized even after conducting the test for 200 hours and in one embodiment, even after conducting the test for 500 hours. Such leakage current may be realized even after conducting the test for 1000 hours.

Furthermore, the leakage current may also be within the aforementioned ranges even after conducting a temperature humidity bias test at a temperature of 85° C., humidity of 85%, and an operating voltage of 32 volts for 100 hours. In particular, such leakage current may be realized even after conducting the test for 200 hours and in one embodiment, even after conducting the test for 500 hours. Such leakage current may be realized even after conducting the test for 1000 hours.

In some embodiments, the varistor may also exhibit a relatively low clamping voltage. In particular, the varistor may have a clamping voltage of 40 volts or less. For example, in some embodiments, the varistor may have a clamping voltage of 12 volts or more, such as 15 volts or more, such as 20 volts or more, such as 25 volts or more, such as 30 volts or more, such as 40 volts or more, such as 45 volts or more, such as 50 volts or more. The clamping voltage may be 500 volts or less, such as 400 volts or less, such as 300 volts or less, such as 250 volts or less, such as 200 volts or less, such as 175 volts or less, such as 150 volts or less, such as 125 volts or less, such as 100 volts or less, such as 90 volts or less, such as 80 volts or less, such as 70 volts or less, such as 60 volts or less, such as 55 volts or less, such as 50 volts or less, such as 40 volts or less, such as 30 volts or less, such as 25 volts or less.

In some embodiments, the varistor may also exhibit low capacitance. For example, the varistor may have a capacitance of about 0.5 μF or more, such as about 1 μF or more, such as about 5 μF or more, such as about 10 μF or more, such as about 25 μF or more, such as about 50 μF or more, such as about 100 μF or more, such as about 200 μF or more, such as about 250 μF or more, such as about 300 μF or more, such as about 400 μF or more, such as about 450 μF or more, such as about 500 μF or more, such as about 1,000 μF or more, such as about 5,000 μF or more, such as about 10,000 μF or more, such as about 25,000 μF or more. The varistor may have a capacitance of about 40,000 μF or less, such as about 30,000 μF or less, such as about 20,000 μF or less, such as about 10,000 μF or less, such as about 5,000 μF or less, such as about 2,500 μF or less, such as about 1,000 μF or less, such as about 900 μF or less, such as about 800 μF or less, such as about 750 μF or less, such as about 700 μF or less, such as about 600 μF or less, such as about 550 μF or less, such as about 500 μF or less, such as about 250 μF or less, such as about 150 μF or less, such as about 100 μF or less, such as about 50 μF or less.

Referring now to the figures, exemplary embodiments of the present disclosure will now be discussed in detail. FIG. 1 illustrates one embodiment of a varistor 10 in accordance with aspects of the present disclosure. The varistor may include a ceramic body 12. In general, the ceramic body 12 includes two opposing end surfaces (i.e., a first end surface 26*a* and a second end surface 26*b*) and four side surfaces (i.e., a first side surface 28 and a second side surface 30 opposing the first side surface 28, a third side surface and a fourth side surface (not shown) opposing the third side surface). As shown, the side surfaces extend between the end surfaces 26*a* and 26*b*. In this regard, in one embodiment, the varistor includes at least six total surfaces.

The varistor 10, in particular the ceramic body 12, may include a plurality of dielectric layers 14. Such dielectric layers 14 may generally be planar. The dielectric layers 14 may include any suitable dielectric material as generally known in the art. For instance, the dielectric material may include barium titanate, zinc oxide, iron oxide, mixtures thereof, or any other suitable dielectric material. In this regard, the dielectric material may be a metal oxide. The metal oxide may be zinc oxide or iron oxide. In on embodiment, the metal oxide may be zinc oxide.

Various additives may be included in the dielectric material, for example, that produce or enhance the voltage-dependent resistance of the dielectric material. For example, in some embodiments, the additives may include oxides of cobalt, bismuth, manganese, antimony, nickel, chromium, silicon, or a combination thereof. In some embodiments, the additives include at least two, such as at least three, such as at least four, such as at least five, such as at least six, such as all seven of the aforementioned oxide additives. In some embodiments, the additives may include oxides of gallium, aluminum, titanium, lead, barium, vanadium, tin, boron, or combinations thereof. The additives may also include nitrates, such as aluminum nitrate. Further, the additives may also include an acid, such as boric acid.

The dielectric material may be doped with the additive(s) ranging from about 0.1 mole % or more, such as about 0.5 mole % or more, such as about 1 mole % or more, such as about 2 mole % or more to about 6 mole % or less, such as about 4 mole % or less, such as about 3 mole % or less, such as about 2 mole % or less. The average grain size of the dielectric material may contribute to the non-linear properties of the dielectric material. In some embodiments, the average grain size may range from about 10 microns to 100 microns, in some embodiments, from about 20 microns to 80 microns.

Referring back to FIG. 1, the varistor 10 may also include electrode layers including a first electrode 16*a* and electrode layers including a second electrode 16*b*. Such electrode layers may generally be planar. The electrode layers may be provided in an alternating configuration. In addition, the electrode layers may be provided in an alternating arrangement with the dielectric layers 14 such that the electrode layers are presented in an interleaved configuration. In this regard, the ceramic body can be formed from a plurality of alternating dielectric layers 14 and electrode layers 16*a* and 16*b*. Furthermore, the ceramic body 12 may be formed by pressing such layers together to form a unitary structure. The layers may be sintered to form the unitary structure prior to the passivation.

The electrodes 16*a* and 16*b* may include any suitable electrode material as generally known in the art. For instance, the electrode material may include and be formed from an electrically conductive metal such as palladium, silver, platinum, copper, nickel, tin, an alloy thereof, a mixture thereof, or another suitable electrically conductive metal, for instance one capable of being printed on the dielectric layer.

In addition, the shape of the electrodes 16*a* and 16*b* and the configuration of electrodes 16*a* and 16*b* within a particular layer between dielectric layers 14 is not limited by the present invention. For instance, the electrodes 16*a* and 16*b* may have a rectangular shape or a T-shape or any other shape as known in the art. In addition, the ceramic body 12 and/or electrode layers may include stub plates adjacent an end surface, dummy electrodes, floating electrodes, no electrodes, or other types of electrodes generally known in the art. Furthermore, it should also be understood that the present disclosure is not limited to any particular number of dielectric 14 and electrode layers 16*a* and 16*b*.

Referring back to FIG. 1, the electrodes 16*a* and 16*b* may be electrically connected to an external terminal 18*a* and 18*b*, respectively. In this regard, the electrodes may be connected to only one external terminal. For instance, first electrode 16*a* may be connected to a first external terminal 18*a* and second electrode 16*b* may be connected to a second external terminal 18*b*. In this regard, each electrode 16*a* and 16*b* is connected to an external terminal 18*a* and 18*b*, respectively. The leading edges of electrodes 16*a* and 16*b* not physically connected to the respective external terminals 18*a* and 18*b*, respectively, extend or project toward the opposing external terminals 18*b* and 18*a*, respectively. In this regard, in one embodiment, electrodes 16*a* and 16*b* may overlap.

The electrodes 16*a* and 16*b* may be connected to an inner surface of the external terminals 18*a* and 18*b* that is adjacent the electrodes 16*a* and 16*b*. In this regard, the external terminals 18*a* and 18*b* also include an outer surface opposite the inner surface for deposition or formation of metal plating layers 22*a* and 22*b*.

The first external terminal 18*a* may be present on the first end surface 26*a* and the second external terminal 18*b* may be present on the second end surface 26*b*. However, the external terminals 18*a* and 18*b* may extend partially onto at least one side surface. In one embodiment, the external terminals 18*a* and 18*b* may extend partially onto at least two side surfaces. In a further embodiment, the external terminals 18*a* and 18*b* may extend partially onto at least all four side surfaces. For instance, the external terminals 18*a* and 18*b* may be present on the two end surfaces 26*a* and 26*b* and extend over the corners to partially cover the edges or extremities of the side surfaces. In this regard, the ceramic body 12 may include a gap 32 on at least one side surface, such as at least two side surfaces that are formed between the external terminals 18*a* and 18*b*. Such gap 32 may be present on all four side surfaces of the ceramic body 12 of the varistor 10. In addition, the external terminals 18*a* and 18*b* may not be present in such gap such that the ceramic body 12 has an exposed surface not covered by the external terminals 18*a* and 18*b*.

The external terminals 18*a* and 18*b* may include any suitable material as generally known in the art. For instance, the material may include and be formed from an electrically conductive metal such as silver, tin, lead, palladium, platinum, copper, nickel, an alloy thereof, or a mixture thereof, or any other suitable electrically conductive metal, for instance one capable of being provided as an external terminal for a varistor. The external terminals 18*a* and 18*b* may also include a glass frit.

The external terminals 18*a* and 18*b* may include metal plating layers 22*a* and 22*b*, respectively, formed thereon. The metal plating layers 22*a* and 22*b* may include one metal plating layer or more than one metal plating layer, such as at least two metal plating layers, such as three metal plating layers. The metal plating layers 22*a* and 22*b* may include any suitable material as generally known in the art. For instance, the material may include and be formed from an electrically conductive metal such as platinum, copper, palladium, silver, nickel, tin, lead, an alloy thereof, a mixture thereof, or other suitable electrically conductive metal, for instance one capable of being provided as a metal plating layer.

A chromium/nickel layer, followed by a silver/lead layer, applied by typical processing techniques such as sputtering, can be used as the outer metal plating layers for the external terminals. Alternatively, the metal plating layers may include a nickel layer following by a tin or tin/lead alloy layer. In this regard, the varistor 10 may include at least one metal plating layer including nickel. In addition, the varistor 10 may include at least one metal plating layer including tin, such as tin/lead.

The thickness of the plating layer(s) is not necessarily limited by the present invention and may be any thickness as desired, in particular for a certain application. Thus, the thickness may be 0.1 microns or more, such as 0.5 microns or more, such as 1 micron or more, such as 2 microns or more, such as 3 microns or more to 10 microns or less, such as 8 microns or less, such as 6 microns or less, such as 5 microns or less, such as 3 microns or less. However, it should be understood that the thickness of the plating layer(s) may be less than 0.1 microns or may be more than 10 microns.

The varistor 10 and ceramic body 12 may also include a passivation layer 24. In general, the passivation layer 24 may be an electrically insulating, inorganic layer. The passivation layer 24 may be formed in the gap 32 on at least one side surface, such as at least two side surfaces that are formed between the external terminals 18*a* and 18*b*. As indicated above, such gap 32 may be present on all four side surfaces of the ceramic body 12 of the varistor 10. In this regard, the passivation layer 24 may be formed in the gap 32 on all of the side surfaces. The passivation layer 24 is formed on the ceramic body 12 between the external terminals 18*a* and 18*b* to protect the ceramic/dielectric during subsequent processing (e.g., formation of the metal plating layers).

The passivation layer 24 may be a phosphate passivation layer 24 formed from a modified phosphoric acid solution as disclosed herein. When the dielectric layers 14 are made from zinc oxide, the passivation layer 24 may include zinc phosphate. In addition, the passivation layer may include a metal additive. In one embodiment, the metal additive may be a non-electrically conductive metal.

In particular, the passivation layer 24 may include a metal additive including an alkali metal, an alkaline earth metal, or a combination thereof. In one embodiment, the passivation layer 24 may include an alkali metal. In another embodiment, the passivation layer 24 may include an alkaline earth metal. In one further embodiment, the passivation layer 24 may include a combination of an alkali metal and an alkaline earth metal.

The alkali metal may be any alkali metal suitable for incorporation in the passivation layer 24. For instance, the alkali metal may include lithium, sodium, potassium, or a mixture thereof. In one embodiment, the alkali metal may include sodium, potassium, or a mixture thereof. In one further embodiment, the alkali metal may include potassium. In another further embodiment, the alkali metal may include sodium.

The alkaline earth metal may be any alkaline earth metal suitable for incorporation in the passivation layer 24. For instance, the alkaline earth metal may include magnesium, calcium, strontium, barium, or a mixture thereof. In particular, the alkaline earth metal may include magnesium, calcium, barium, or a mixture thereof. In one embodiment, the alkaline earth metal may include magnesium, calcium or a mixture thereof. In one further embodiment, the alkaline earth metal may include magnesium. In another further embodiment, the alkaline earth metal may include calcium.

In one particular embodiment, the passivation layer 24 includes a combination of an alkali metal and an alkaline earth metal. In this regard, the combination may include an alkali metal including lithium, sodium, potassium, rubidium, caesium, francium, or a mixture thereof and an alkaline earth metal including beryllium, magnesium, calcium, strontium, barium, radium, or a mixture thereof. In particular, the combination may include an alkali metal including lithium, sodium, potassium, or a mixture thereof and an alkaline earth metal including magnesium, calcium, or a mixture thereof. For instance, the combination may include potassium and magnesium and/or calcium, such as potassium, magnesium, and calcium.

The molar (or elemental) ratio of the moles (or number of atoms) of phosphorus of the phosphate to the moles (or number of atoms) of the metal additive in the passivation layer (or on a surface of the passivation layer) may be 0.01 or more, such as 0.1 or more, such as 0.2 or more, such as 0.25 or more, such as 0.5 or more, such as 1 or more, such as 2 or more, such as 4 or more, such as 5 or more, such as 8 or more, such as 10 or more. The molar (or elemental) ratio of the moles (or number of atoms) of phosphorus of the phosphate to the moles (or number of atoms) of the metal additive may be 100 or less, such as 75 or less, such as 50 or less, such as 40 or less, such as 25 or less, such as 15 or less, such as 10 or less, such as 7 or less, such as 5 or less, such as 4 or less, such as 3 or less. Such ratio can be determined using various techniques as generally known in the art, such as energy-dispersive x-ray spectroscopy and scanning electron microscopy.

The molar (or elemental) ratio of the moles (or number of atoms) of zinc of the zinc oxide to the moles (or number of atoms) of the metal additive in the passivation layer (or on a surface of the passivation layer) may be 0.01 or more, such as 0.1 or more, such as 0.2 or more, such as 0.25 or more, such as 0.5 or more, such as 1 or more, such as 2 or more, such as 4 or more, such as 5 or more, such as 8 or more, such as 10 or more. The molar (or elemental) ratio of the moles (or number of atoms) of zinc of the zinc oxide to the moles (or number of atoms) of the metal additive may be 100 or less, such as 75 or less, such as 50 or less, such as 40 or less, such as 25 or less, such as 15 or less, such as 10 or less, such as 7 or less, such as 5 or less, such as 4 or less, such as 3 or less. Such ratio can be determined using various techniques as generally known in the art, such as energy-dispersive x-ray spectroscopy and scanning electron microscopy.

As indicated above, the metal additive can be present in the passivation layer. In addition, such metal additive may also be present on the surface of the passivation layer as can be detected via energy-dispersive x-ray spectroscopy and scanning electron microscopy. The aforementioned molar (or elemental) ratios may also apply to the ratio on the passivation layer as determined via energy-dispersive x-ray spectroscopy and scanning electron microscopy.

While FIG. 1 provides one embodiment of a varistor, it should be understood that the present invention is not limited by the type of varistor and materials employed in forming such varistor. In particular, it should be understood that the present invention may be suitable for any varistor which can utilize a passivation layer as disclosed herein.

Figure 2A:
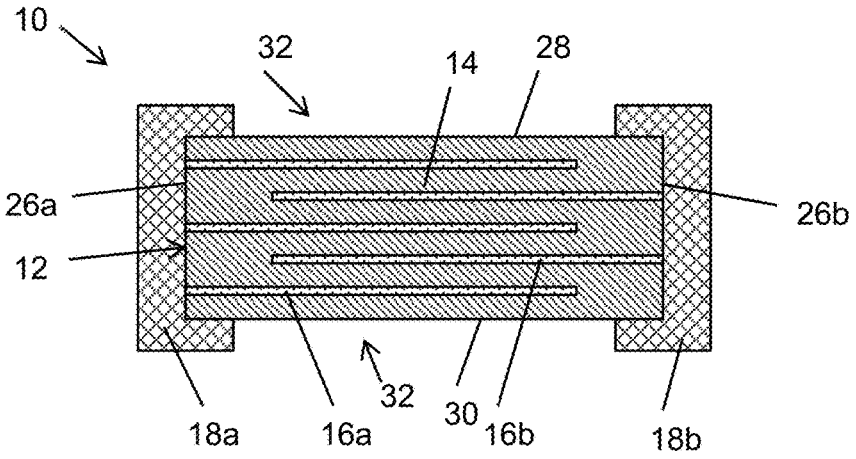
FIGS. 2*a*-2*c* illustrate method of making a varistor including a passivation layer in accordance with aspects of the present disclosure.
Figure 2B:
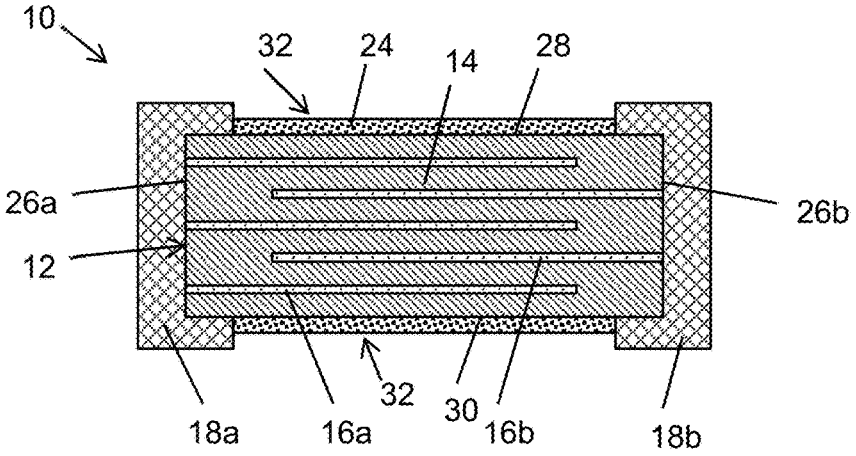
Figure 2C:
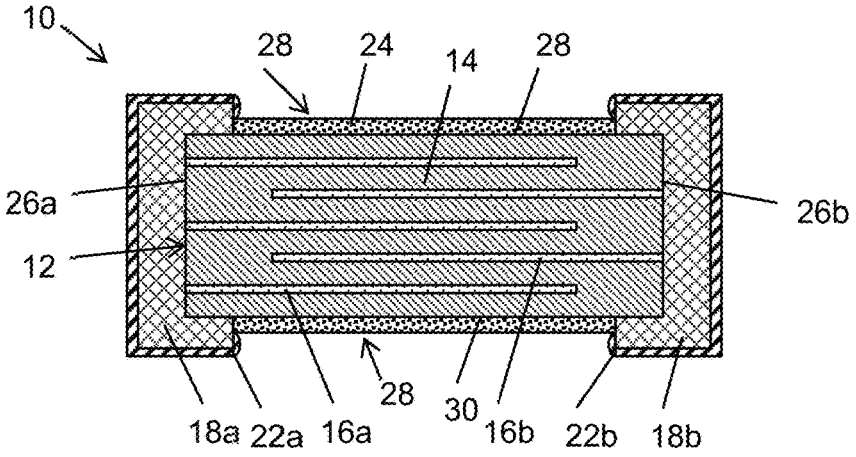

As indicated herein, the present invention is also directed to a method of forming a varistor having a passivation layer as disclosed herein. Reference to FIGS. 2*a*-2*c* provides at least one manner of forming a varistor as disclosed herein.

As indicated in FIG. 2*a*, the method includes providing a ceramic body 12 including a plurality of alternating dielectric layers 14 and electrode layers 16*a* and 16*b* as mentioned above. The method may, in one embodiment, include a step of providing a ceramic body 12 including a plurality of alternating dielectric layers 14 and electrode layers 16*a* and 16*b* as mentioned above as well as external terminals 18*a* and 18*b* as mentioned above.

Alternatively, the method may include a step of forming external terminals 18*a* and 18*b* on at least two opposing end surfaces. The external terminals 18*a* and 18*b* may be formed using any means known in the art. For instance, in one embodiment, the external terminals may be formed by applying a paste, such as a conductive paste. In particular, the external terminals may be formed by dipping the end surfaces of the ceramic body into the paste.

The paste may include a conductive metal such as silver, tin, lead, palladium, platinum, copper, nickel, an alloy thereof, or a mixture thereof, or any other conductive metal known in the art. The paste may also include a glass frit. In this regard, the paste may include the metal and a glass frit. Also, the paste may include a carrier. The metals may be included in the paste in an amount of 25 wt. % or more, such as 50 wt. % or more, such as 60 wt. % or more, such as 70 wt. % or more, such as 75 wt. % or more. The balance may be the glass frit and the carrier.

In this regard, the external terminals 18*a* and 18*b* may be a "thick-film" terminal as generally understood in the art. However, it should be understood that in certain embodiments, the external terminals 18*a* and 18*b* may also be a "thin-film" terminal as generally understood in the art. Such "thin-film" terminals may be formed via certain techniques including certain electroless or electrolytic plating techniques.

Prior to forming the external terminals 18*a* and 18*b*, the ceramic body 12 including the dielectric layers 14 and electrodes 16*a* and 16*b* may be sintered to form a unitary structure. Such sintering may be at a temperature of at least 400° C., such as at least 500° C., such as at least 700° C., such as at least 1000° C., such as at least 1100° C. Such sintering may be for any desired time in order to obtain the desired properties.

The ceramic body 12 with the external terminal materials may be fired or sintered. Such firing or sintering may be employed to cure the terminal material to provide the external terminals 18*a* and 18*b*. For instance, this may allow the glass frit to melt to sufficiently bind the metal particles. The temperature may be 300° C. or more, such as 400° C. or more, such as 500° C. or more, such as 550° C. or more, such as 600° C. or more. The temperature may be 1200° C. or less, such as 1000° C. or less, such as 950° C. or less, such as 900° C. or less, such as 850° C. or less, such as 800° C. or less, such as 700° C. or less. Such sintering may be for any desired time in order to obtain the desired properties. For instance, such sintering may be conducted for at least 1 minute, such as at least 5 minutes, such as at least 15 minutes, such as at least 30 minutes, such as at least 1 hour.

After firing, the ceramic body 12 with the external terminals 18*a* and 18*b* may be washed or cleaned. Such washing may be using any liquid or solvent suitable in the art. For instance, such liquid or solvent may include water (e.g., deionized water, acetone, and/or an alcohol, such as ethanol. The washing may include a separate washing of ethanol followed by a washing with water. Thereafter, the ceramic body with the external terminals may be dried, such as at room temperature or an elevated temperature of 25° C. or more, such as 50° C. or more, such as 75° C. or more, such as 85° C. or more.

Thereafter, as illustrated in FIG. 2*b*, passivation layer 24 is formed in the gaps 32 between the external terminals 18*a* and 18*b*. The passivation layer 24 may be formed using a phosphoric acid solution, in particular a modified phosphoric acid solution as disclosed herein. The phosphoric acid solution includes any phosphoric acid generally employed in the art for forming a phosphate layer as disclosed herein. As known in other words, the phosphoric acid may be orthophosphoric acid. In addition, the phosphoric acid solution is a modified solution containing additional components. In particular, the solution may include a metal additive as mentioned above with respect to the passivation layer 24.

The metal additive may be delivered via a compound, such as a metal additive compound. The metal additive compound may be an inorganic compound. The metal additive compound may be one that disassociates in the phosphoric acid solution in order to allow for the metal additive to be present in the passivation layer.

In one embodiment, the metal additive compound may be a salt, in particular an inorganic salt. For instance, the salt may be a carbonate, a sulfate, a nitrate, a halide (e.g., chloride, iodide, bromide), etc., or a mixture thereof. In one embodiment, the salt may be a carbonate, such as a magnesium carbonate, a calcium carbonate, and/or a potassium carbonate. Alternatively, the metal additive compound may be a salt that provides a base, such as a hydroxide. Alternatively, the metal additive compound may be a base, such as a strong base. In particular, the base may be a hydroxide, such as a potassium hydroxide, a calcium hydroxide, and/or a magnesium hydroxide.

The modified phosphoric solution may also have additional components. For instance, the solution may also include metal ions. Such metal ions may correspond to the metal of the dielectric (e.g., zinc if the dielectric is formed from zinc oxide). By including such metal in the phosphoric acid solution, it could assist in the formation of the phosphate for the passivation layer. For instance, the phosphate may form in solution and deposit onto the exposed surface of the ceramic body.

In addition, the modified phosphoric solution may also have a liquid carrier. The liquid carrier may be water, an organic solvent, or a combination thereof. In one embodiment, the liquid carrier includes water. The liquid carrier may be present in the solution in an amount of 50 wt. % or more, such as 60 wt. % or more, such as 70 wt. % or more, such as 80 wt. % or more, such as 90 wt. % or more, such as 95 wt. % or more to less than 100 wt. %, such as 99 wt. % or less.

The modified phosphoric solution may also include a pH modifier. In one embodiment, the pH modifier may be a base pH modifier. For instance, the pH modifier may include a strong base. The pH modifier may include a hydroxide, in particular any hydroxide known in the art. In one embodiment, the pH modifier may include ammonium hydroxide. The amount of pH modifier used is not limited and may be utilized until a desired pH is obtained.

The pH of the solution may be an acidic pH. In particular, the pH may be less than 7, such as 6 or less, such as 5 or less, such as 4 or less. The pH may be 1 or more, such as 2 or more, such as 3 or more, such as 4 or more, such as 4.5 or more.

The solution may contain the phosphoric acid in an amount of 0.01 wt. % or more, such as 0.05 wt. % or more, such as 0.1 wt. % or more, such as 0.25 wt. % or more, such as 0.5 wt. % or more, such as 0.75 wt. % or more, such as 1 wt. % or more, such as 1.25 wt. % or more, such as 1.5 wt. % or more, such as 2 wt. % or more, such as 3 wt. % or more, such as 3.5 wt. % or more. The solution may contain the phosphoric acid in an amount of 10 wt. % or less, such as 7.5 wt. % or less, such as 5 wt. % or less, such as 3 wt. % or less, such as 2.5 wt. % or less, such as 2 wt. % or less, such as 1.75 wt. % or less.

The solution may contain the metal additive compound in an amount of 0.01 wt. % or more, such as 0.05 wt. % or more, such as 0.1 wt. % or more, such as 0.25 wt. % or more, such as 0.5 wt. % or more, such as 0.75 wt. % or more, such as 1 wt. % or more, such as 1.25 wt. % or more, such as 1.5 wt. % or more. The solution may contain the metal additive in an amount of 10 wt. % or less, such as 7.5 wt. % or less, such as 5 wt. % or less, such as 3 wt. % or less, such as 2.5 wt. % or less, such as 2 wt. % or less, such as 1.75 wt. % or less.

The solution may contain the metal additive of the metal additive compound in an amount of 0.01 wt. % or more, such as 0.05 wt. % or more, such as 0.1 wt. % or more, such as 0.25 wt. % or more, such as 0.5 wt. % or more, such as 0.75 wt. % or more, such as 1 wt. % or more, such as 1.25 wt. % or more, such as 1.5 wt. % or more. The solution may contain the metal additive in an amount of 10 wt. % or less, such as 7.5 wt. % or less, such as 5 wt. % or less, such as 3 wt. % or less, such as 2.5 wt. % or less, such as 2 wt. % or less, such as 1.75 wt. % or less.

The weight ratio of the phosphoric acid to the metal additive compound in the solution may be 0.01 or more, such as 0.1 or more, such as 0.2 or more, such as 0.25 or more, such as 0.5 or more, such as 1 or more, such as 2 or more, such as 4 or more, such as 5 or more, such as 8 or more, such as 10 or more. The weight ratio of the phosphoric acid to the metal additive compound in the solution may be 100 or less, such as 75 or less, such as 50 or less, such as 40 or less, such as 25 or less, such as 15 or less, such as 10 or less, such as 7 or less, such as 5 or less.

The molar (or elemental) ratio of the moles of phosphorus of the phosphoric acid to the moles of the metal additive of the metal additive compound in the solution may be 0.01 or more, such as 0.1 or more, such as 0.2 or more, such as 0.25 or more, such as 0.5 or more, such as 1 or more, such as 2 or more, such as 4 or more, such as 5 or more, such as 8 or more, such as 10 or more. The molar ratio of the moles of phosphorus of the phosphoric acid to the moles of the metal additive of the metal additive compound in the solution may be 100 or less, such as 75 or less, such as 50 or less, such as 40 or less, such as 25 or less, such as 15 or less, such as 10 or less, such as 7 or less, such as 5 or less.

The passivation layer 24 may be formed by applying the passivation material, such as the phosphoric acid solution, to a component including a ceramic body, in particular a ceramic body with external terminals. The passivation material may be applied by coating, dipping, spraying, misting, etc. In one embodiment, the passivation material is applied by spraying the ceramic body with the phosphoric acid solution. In another embodiment, the passivation material is applied by dipping the ceramic body into the phosphoric acid solution. In general, the phosphate layer may not form on the external terminals, for example when including silver, because such phosphate layer may not react to form and adhere to such end terminals.

The passivation layer can be formed by reacting the dielectric material with the passivation material. For instance, when the dielectric material includes zinc oxide and the passivation material includes phosphoric acid, the reaction may yield a passivation layer including zinc phosphate. The reaction may occur at a desired temperature and for a desired period of time. For instance, in one embodiment, the reaction may occur at ambient temperature. Alternatively, the reaction may occur at an elevated temperature, such that the phosphoric acid solution is heated to such temperature. For instance, the temperature may be 15° C. or more, such as 30° C. or more, such as 50° C. or more, such as 55° C. or more, such as 60° C. or more to 100° C. or less, such as 90° C. or less, such as 80° C. or less, such as 70° C. or less, such as 65° C. or less. The reaction may take place for 1 minute or more, such as 5 minutes or more, such as 10 minutes or more, such as 20 minutes or more, such as 25 minutes or more to 60 minutes or less, such as 50 minutes or less, such as 40 minutes or less, such as 35 minutes or less.

After the reaction, the ceramic body 12 with the external terminals 18*a* and 18*b* and the passivation layer 24 may be cleaned. For instance, it may be rinsed with water (e.g., deionized water) or an alcohol. In one embodiment, the washing is with water.

After the reaction and after the drying, the ceramic body 12 with the external terminals 18*a* and 18*b* and the passivation layer 24 may be dried. Such drying may be at room temperature or an elevated temperature of 25° C. or more, such as 50° C. or more, such as 60° C. or more, such as 65° C. or more. Such drying may be for any amount of time as necessary such as 5 minutes or more, such as 30 minutes or more, such as 1 hour or more, such as 2 hours or more, such as 4 hours or more, such as 5 hours or more, such as 6 hours or more.

In addition, after formation of the passivation layer and prior to forming the metal plating layers, the ceramic body may be fired or sintered at an elevated temperature. Such firing or sintering may allow for further stability of the passivation layer which may assist in formation of the metal plating layer. The temperature may be 300° C. or more, such as 400° C. or more, such as 500° C. or more, such as 550° C. or more, such as 600° C. or more. The temperature may be 900° C. or less, such as 850° C. or less, such as 800° C. or less, such as 700° C. or less. Such sintering may be for any desired time in order to obtain the desired properties. For instance, such sintering may be conducted for at least 1 minute, such as at least 5 minutes, such as at least 15 minutes, such as at least 30 minutes, such as at least 1 hour.

Thereafter, as illustrated in FIG. 2*c*, metal plating layers 22*a* and 22*b* are formed on the external terminals 18*a* and 18*b*, respectively. In this regard, the method includes a step of forming the metal plating layers or in other words, a step of plating the external terminals to form a metal plating layer. The metal plating layers may be formed using any method generally known in the art. For instance, the metal plating layers may be formed by electroplating, electroless plating, spray plating, rolling plating processes, etc. For instance, the metal plating layers may be formed by barrel plating, in particular barrel electroplating. With the presence of the passivation layer, there is minimal risk of the ceramic/dielectric present between the external terminals on the side surfaces of also being plated. In this regard, the metal plating layers adhere to the electrically charged portions of the body, such as the external terminals 18*a* and 18*b*, and not the passivation layer 24 as it is electrically insulative and not electrically conductive.

The metal plating layers are formed by applying a metal plating solution using the various techniques mentioned above. The metal plating solutions are not necessarily limited and may be any generally employed in the art. For instance, when the layer includes nickel, the metal plating solution may be a nickel plating solution including nickel sulphate or nickel chloride. The solution may also include other additives as generally known in the art, such as acids (e.g., boric acid), wetting agents, etc. When the layer includes tin, the metal plating solution may be a tin plating solution including alkyl-tin, alkyl-tin-lead, tin-lead sulfuric acid, or tin sulfuric acid. Such plating solutions may have a pH of 2 or more, such as 3 or more, such as 4 or more, such as 5 or more, such as 6 or more to 7 or less, such as 6 or less, such as 5 or less. The pH may be from 2 to 7, such as from 2 to 6, such as from 3 to 6, such as from 4 to 6 or such as from 6 to 7.

In general, the passivation layer may remain in the final product as additional protection. In this regard, in one embodiment, the passivation layer may not be removed from the device. However, in another embodiment, the passivation layer may be removed from the ceramic body and varistor.

The varistor as disclosed herein may have many different applications in a wide variety of devices. For instance, the varistor may be used in radio frequency antenna/amplifier circuits. The varistor may also find application in various technologies including laser drivers, sensors, radars, radio frequency identification chips, near field communication, data lines, Bluetooth, optics, Ethernet, and in any suitable circuit. The varistor disclosed herein may also find particular application in the automotive industry. For example, the varistor may be used in any of the above-described circuits in automotive applications. For such applications, passive electrical components may be required to meet stringent durability and/or performance requirements. Furthermore, the varistor may find particular application in data processing and transmission technologies.

The present invention may be better understood with reference to the following example.

EXAMPLES

Test Methods

The following sections provide example methods for testing varistors to determine various varistor characteristics.

Clamping and Breakdown Voltage: The clamping voltage of the varistor may be measured using a Frothingham Electronic Corporation FEC CV400 Unit. The clamping voltage may be accurately measured as the maximum voltage measured across the varistor during a 8×20 μs current pulse, in which the rise time is 8 μs, and the decay time is 20 μs in accordance with ANSI Standard C62.1. This remains true as long as the peak current value is not so great that it damages the varistor.

The breakdown voltage may be detected at as the inflection point in the current vs. voltage relationship of the varistor. For voltages greater than breakdown voltage, the current may increase more rapidly with increasing voltage compared with voltages that are less than the breakdown voltage. For voltages less than the breakdown voltage, an ideal varistor may generally exhibit voltages approximately according to the following relationship:

$$V=CI^{\beta}$$

where V represents voltage; I represents current; and C and β are constants that depend on the specifics of the varistor (e.g., material properties). For varistors, the constant β is generally less than 1 such that the voltage increases less rapidly than an ideal resistor according to Ohm's law in this region.

For voltages greater than the breakdown voltage, however, the current vs. voltage relationship may generally approximately follow Ohm's law, in which current is linearly related with voltage:

$$V=IR$$

in which, V represents voltage; I represents current; and R is a large constant resistance value. The current vs voltage relationship may be measured as described above, and any suitable algorithm may be used to determine the inflection point in the empirically collected current vs. voltage data set.

Example 1

A zinc oxide powder was made by calcining zinc oxide with various oxide additives in a first step. In a second step, the calcined powder was mixed with bismuth oxide. Thereafter, a ceramic body including electrodes was formed with external terminals as illustrated in FIG. 2*a* and the exposed ceramic was reacted with a modified phosphoric acid solution according to the specifications and conditions provided in the table below:

| Sample | Phosphoric Acid Solution | Temperature (° C.) | Time (min) |
|---|---|---|---|
| Comparative Sample 1 | 100 mL 4% $H_3PO_4$ (adjusted to pH of 4.6 using $NH_4OH$) | 60 | 25 |
| Sample 2 | 100 mL 4% $H_3PO_4$ + 2 mL 45% KOH soln. (adjusted to pH of 4.8 using $NH_4OH$) | 60 | 25 |
| Sample 3 | 100 mL 4% $H_3PO_4$ + 0.5 g $MgCO_3$ (adjusted to pH of 4.7 using $NH_4OH$) | 60 | 25 |

Once the passivation layers were formed as illustrated in FIG. 2*b*, the surface morphology was analyzed. In particular, it was observed that the metal additive can result in a different morphology of the passivation layer. FIG. 3 illustrates the surface morphology of the exposed ceramic body ("Control") as well as the passivation layers formed according to Comparative Sample 1 and Samples 2 and 3. As indicated by the images, the inclusion of potassium (Sample 2) decreases the crystal size while the inclusion of magnesium (Sample 3) increases the crystal size in comparison to the phosphate layer without a metal additive (Comparative Sample 1). In particular, a star-like structure is seen in the image for Comparative Sample 1. Meanwhile, the inclusion of potassium (Sample 2) results in a smaller needle-like structure and the inclusion of magnesium (Sample 3) results in combination of a star-like structure and a needle-like structure.

Thereafter, the ceramic bodies including the passivation layers were calcined at 650° C. and the surface morphology was analyzed as illustrated in FIG. 4. As illustrated, the structure and morphology of the crystals changes upon calcination. In particular, the crystal structure appears to collapse and form a glassy looking surface thereby making the layer more stable and electrically non-conducting (i.e., electrically insulative).

Figure 5:
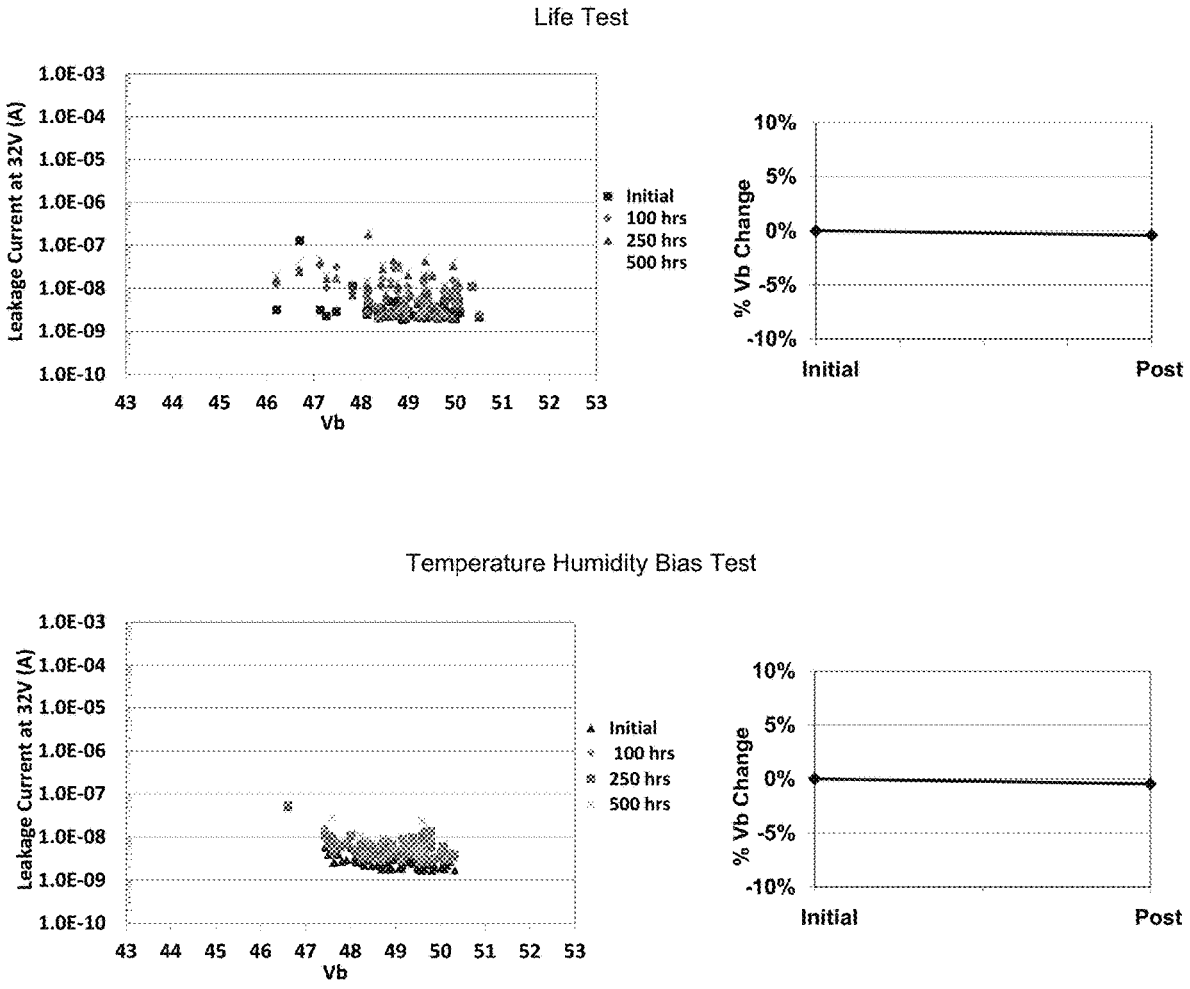
FIGS. 5 and 6 illustrate the results of a life test and temperature humidity bias test in accordance with an example of the present disclosure.
Figure 6:
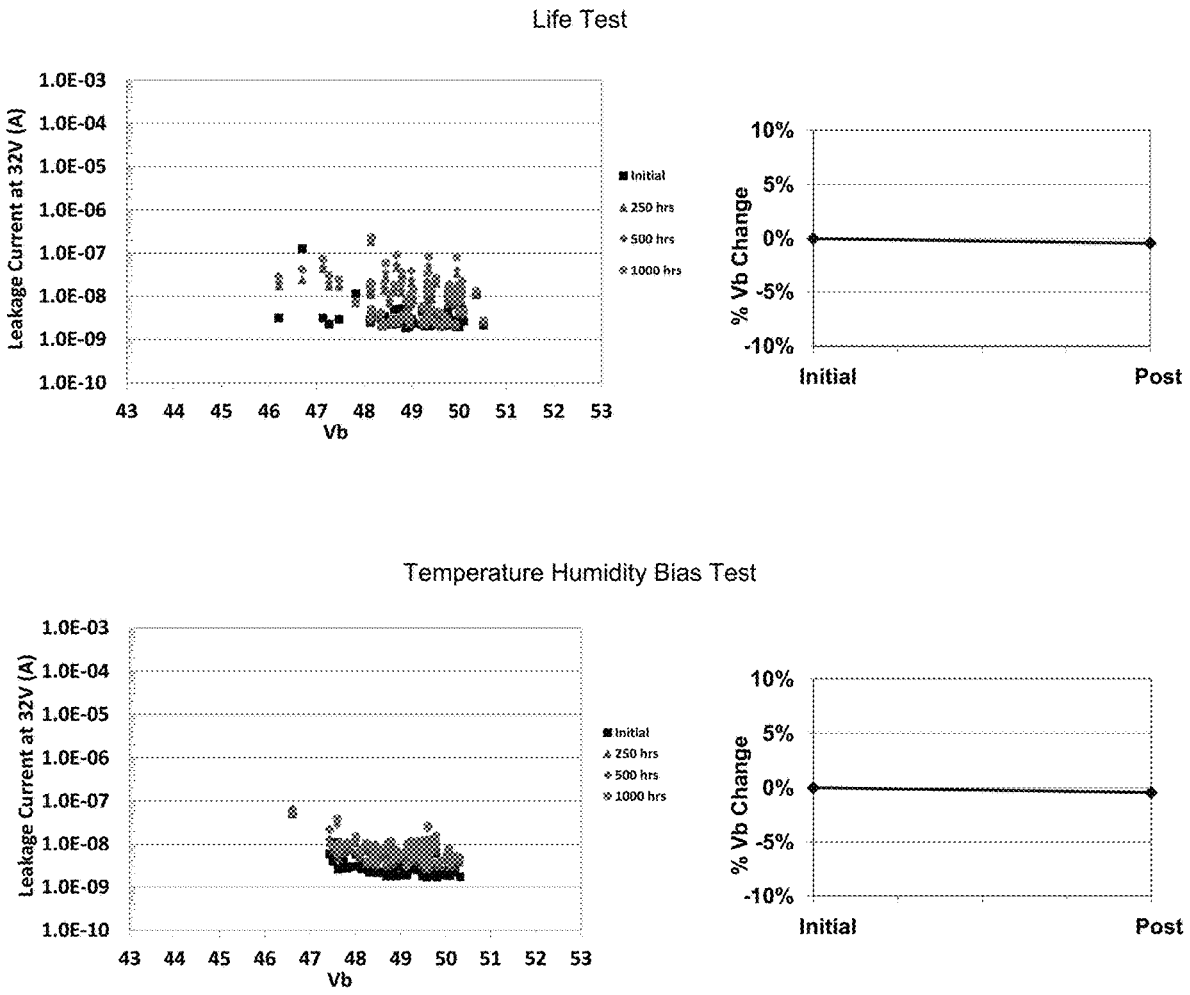

For Sample 3, a life test and temperature humidity bias test were performed as described herein. In particular, the leakage current and breakdown voltage were determined after conducting the tests at an operating voltage of 32 volts for 500 hours and 1000 hours. The leakage current was then plotted against the breakdown voltage. The results are illustrated in FIG. 5 (500 hours) and FIG. 6 (1000 hours) and demonstrate a minimal change in the leakage current and/or breakdown voltage upon the conclusion of both tests. As illustrated, the percent change in breakdown voltage was 0.5% or less.

These and other modifications and variations of the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A varistor comprising: a ceramic body comprising a plurality of alternating dielectric layers and electrode layers, a first external terminal on a first end surface and a second external terminal on a second end surface opposite the first end surface, at least two side surfaces extending between the first end surface and the second end surface, a passivation layer on at least one side surface of the ceramic body between the first external terminal and the second external terminal, wherein the passivation layer includes a phosphate and a metal additive including an alkali metal, an alkaline earth metal, or a mixture thereof, wherein the passivation layer has an average thickness of from 0.1 microns to 30 microns.

2. The varistor according to claim 1, wherein the metal additive comprises an alkali metal.

3. The varistor according to claim 2, wherein the alkali metal comprises potassium.

4. The varistor according to claim 1, wherein the metal additive comprises an alkaline earth metal.

5. The varistor according to claim 4, wherein the alkaline earth metal comprises magnesium.

6. The varistor according to claim 1, wherein the elemental ratio of the moles of phosphorus of the phosphate to the moles of the metal additive may be from 0.01 to 100 as determined by energy-dispersive x-ray spectroscopy.

7. The varistor according to claim 1, wherein the dielectric layers include a dielectric material comprising zinc oxide.

8. The varistor according to claim 7, wherein the phosphate includes zinc phosphate.

9. The varistor according to claim 1, further comprising a metal plating layer on the first external terminal and the second external terminal.

10. The varistor according to claim 9, wherein the metal plating layer comprises nickel or tin.

11. The varistor according to claim 1, wherein the varistor has a breakdown voltage of from 20 volts to 80 volts.

12. The varistor according to claim 1, wherein the varistor has a breakdown voltage of at least 90% of an initial breakdown voltage after undergoing a life test conducted at an operating voltage of 32 volts and a temperature of 1250 C for 500 hours.

13. The varistor according to claim 1, wherein the varistor has a breakdown voltage of at least 90% of an initial breakdown voltage after undergoing a temperature humidity bias test conducted at a temperature of 850 C, a humidity of 85%, and an operating voltage of 32 volts for 500 hours.

14. A method of manufacturing the varistor of claim 1, the method comprising: applying a solution containing a phosphoric acid and a metal additive including an alkali metal, an alkaline earth metal, or a mixture thereof to a component including the ceramic body, the first external terminal, and the second external terminal.

15. The method according to claim 14, wherein the solution includes an inorganic compound containing the metal additive.

16. The method according to claim 14, wherein the metal additive comprises an alkali metal.

17. The method according to claim 16, wherein the alkali metal comprises potassium.

18. The method according to claim 14, wherein the metal additive comprises an alkaline earth metal.

19. The method according to claim 18, wherein the alkaline earth metal comprises magnesium.

20. The method according to claim 15, wherein the compound includes an inorganic salt.

21. The method according to claim 20, wherein the inorganic salt includes a carbonate.

22. The method according to claim 15, wherein the compound includes a base.

23. The method according to claim 22, wherein the base includes a hydroxide.

24. The method according to claim 14, wherein the solution further comprises a base pH modifier.

25. The method according to claim 14, wherein the phosphoric acid is present in the solution in an amount of from 0.01 wt. % to 10 wt. %.

26. The method according to claim 15, wherein the compound is present in the solution in an amount of from 0.01 wt. % to 10 wt. %.

27. The method according to claim 14, wherein the elemental ratio of the moles of phosphorus of the phosphoric acid to the moles of the metal additive may be from 0.01 to 100.

28. The method according to claim 14, wherein the dielectric material of the dielectric layers of the ceramic body comprises zinc oxide and the applying of the solution results in a reaction creating zinc phosphate.

29. The method according to claim 14, further comprising forming a first metal plating layer on the first external terminal and the second external terminal.

* * * * *